US008915770B2

(12) United States Patent
Lee

(10) Patent No.: US 8,915,770 B2
(45) Date of Patent: Dec. 23, 2014

(54) WAFER POLISHING APPARATUS

(75) Inventor: Hyung-Rak Lee, Yeongcheon-si (KR)

(73) Assignee: LG Siltron, Inc., Gyeongbuk (KR)

( * ) Notice: Subject to any disclaimer, the term of this patent is extended or adjusted under 35 U.S.C. 154(b) by 808 days.

(21) Appl. No.: 13/004,873

(22) Filed: Jan. 11, 2011

(65) Prior Publication Data

US 2011/0171886 A1 Jul. 14, 2011

(30) Foreign Application Priority Data

Jan. 11, 2010 (KR) ..... 10-2010-0002311

(51) Int. Cl.

| | |
|---|---|
| ***B24B 7/00*** | (2006.01) |
| ***B24B 37/08*** | (2012.01) |
| ***B24B 37/11*** | (2012.01) |
| ***B24D 13/12*** | (2006.01) |

(52) U.S. Cl.

CPC ..... *B24B 37/08* (2013.01); *B24B 37/11* (2013.01); *B24D 13/12* (2013.01)

USPC ..... 451/65; 451/190; 451/194; 451/446

(58) Field of Classification Search

USPC ..... 451/60, 65, 66, 190, 194, 241, 267, 451/282, 397, 402, 446, 495, 541, 545

See application file for complete search history.

(56) References Cited

U.S. PATENT DOCUMENTS

| | | | | |
|---|---|---|---|---|
| 294,766 | A * | 3/1884 | Coy | 451/303 |
| 5,501,629 | A | 3/1996 | Kawana et al. | |
| 6,196,901 | B1 * | 3/2001 | Minami | 451/63 |
| 6,328,640 | B1 * | 12/2001 | Jones et al. | 451/194 |
| 6,537,139 | B2 * | 3/2003 | Ohmori | 451/56 |
| 6,685,547 | B2 * | 2/2004 | Boman | 451/495 |
| 6,692,339 | B1 * | 2/2004 | Halley | 451/41 |
| 6,837,777 | B2 * | 1/2005 | Ziemins et al. | 451/44 |
| 7,077,731 | B1 * | 7/2006 | Zhang | 451/194 |
| 8,087,419 | B2 * | 1/2012 | Kaneko et al. | 134/157 |
| 8,162,724 | B2 * | 4/2012 | Yamauchi et al. | 451/36 |

FOREIGN PATENT DOCUMENTS

| | | |
|---|---|---|
| JP | 06-126611 | 5/1994 |
| JP | 10-113856 | 5/1998 |
| JP | 10-235556 | 9/1998 |
| JP | 11-90801 | 4/1999 |
| JP | 2000-108022 | 4/2000 |
| JP | 2000-317820 | 11/2000 |
| JP | 2001-30158 | 2/2001 |
| JP | 2009-285774 | 12/2009 |

OTHER PUBLICATIONS

Japanese Patent Application No. 2012-547952, Notice of Allowance dated Jan. 28, 2014 (No English Translation).

Japanese Patent Application No. 2012-547952, Office Action dated Sep. 3, 2013.

* cited by examiner

*Primary Examiner* — Timothy V Eley

(74) *Attorney, Agent, or Firm* — Lewis Roca Rothgerber LLP

(57) ABSTRACT

A wafer polishing apparatus is provided. The wafer polishing apparatus includes a first polishing roller disposed on a wafer, the first polishing roller extending in a direction in which the wafer extends and a second polishing roller disposed under the wafer, the second polishing roller extending in the direction in which the wafer extends. The wafer polishing apparatus uses the roller to polish the wafer. Thus, the wafer polishing apparatus may easily polish a wafer having a large area.

13 Claims, 8 Drawing Sheets

WAFER POLISHING APPARATUS

CROSS-REFERENCE TO RELATED APPLICATIONS

The present application claims the priority benefit of Korean patent application number 10-2010-0002311 filed Jan. 11, 2010.

BACKGROUND OF THE INVENTION

1. Field of the Invention

Embodiments related to a wafer polishing apparatus.

2. Description of the Related Art

A main process of manufacturing a silicon wafer includes a slice process in which a single crystal ingot is sliced to generate a wafer having a thin disk shape, a chamfering process in which an outer peripheral portion is chamfered to prevent the wafer generated by the slice process from cracking or being recessed, a lapping process for planarizing the wafer, an ashing process for removing deformed portions remaining on the wafer in which the chamfering and lapping processes are completed, a polishing process for polishing a surface of the wafer, and a cleaning process for removing foreign substances.

The polishing process among the above-described processes may be classified into a single side polishing process and a double side polishing process. The both sides (double side) polishing process is a process for polishing both surfaces of the wafer, i.e., top and bottom surfaces of the wafer.

SUMMARY OF THE INVENTION

Embodiments provide an economical and efficient wafer polishing apparatus. Here, an additional process may be added according to manufacturing environments and a specification of a target wafer, and the above-described processes may be changed somewhat in order.

In one embodiment, a wafer polishing apparatus includes: a first polishing roller disposed on a wafer, the first polishing roller extending in a direction in which the wafer extends; and a second polishing roller disposed under the wafer, the second polishing roller extending in the direction in which the wafer extends.

In another embodiment, a wafer polishing apparatus includes: a polishing part disposed on a top or bottom surface of a wafer; and a rotation driving module contacting an edge portion of the wafer to transmit a rotation force to the wafer.

In further another embodiment, a wafer polishing apparatus includes: a first polishing roller disposed on a first wafer; a second polishing roller disposed between the first wafer and a second wafer facing the first wafer; and a third polishing roller disposed under the second polishing roller.

The details of one or more embodiments are set forth in the accompanying drawings and the description below. Other features will be apparent from the description and drawings, and from the claims.

DETAILED DESCRIPTION

Figure 1:
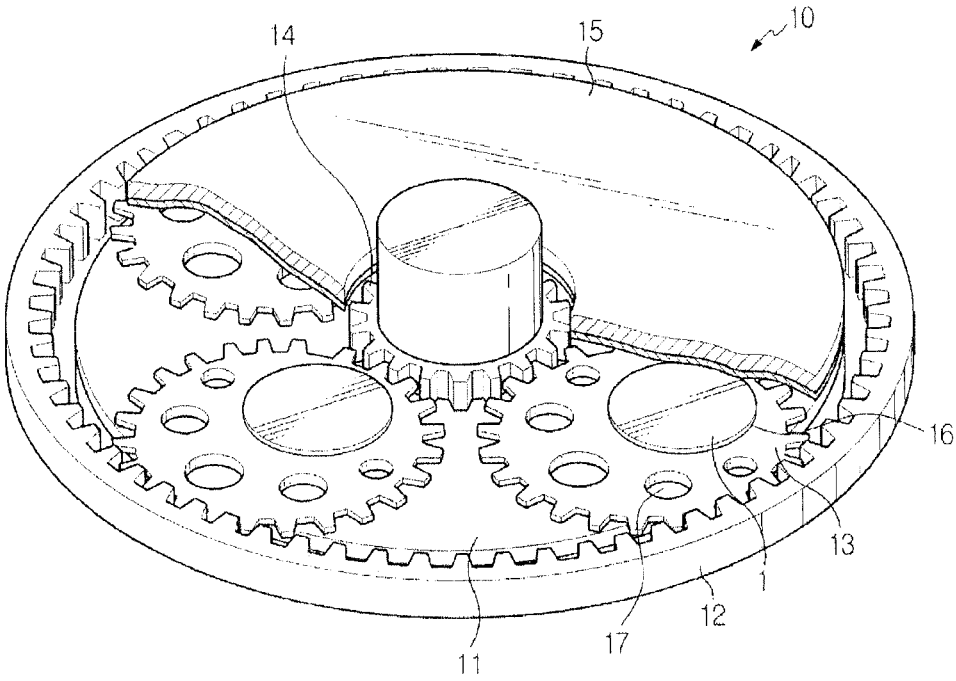
FIG. 1 is a perspective view of a double side polishing apparatus according to a first embodiment.

The wafer polishing apparatus according to the embodiments may not polish the wafer using the upper plate and the lower plate, but polish the wafer using the roller. Thus, it is not required to manufacture the pad having a size corresponding to that of the plate. That is, the pad having a small size may be required for polishing the wafer.

Thus, the embodiments may realize the double side polishing apparatus having significantly improved effects in size of the apparatus, unit price, operation costs, process performing time, and process efficiency. Also, in the wafer polishing apparatus according to the embodiments, the number of the target wafers may be increased to further improve yield.

Also, since the wafer polishing apparatus according to the embodiments does not use the carrier on which the wafer is mounted, the wear of the edge portion occurring by the carrier and the quality deterioration due to the wear may be fundamentally improved. Particularly, since it is very important to secure good quality at the edge portion as the wafer is increased in size, the wafer polishing apparatus according to the embodiments may manufacture wafers having further improved and advanced quality.

In the aspects of the pad, since the wafer polishing apparatus according to the embodiments uses the pad having the small size, the manufacturing costs may be reduced, and the pad may have or maintain uniform physical property on the entire surface thereof. Thus, a cause of quality degradation due to instable pad mounting such as air pocket may be removed.

Furthermore, the wafer polishing apparatus according to the embodiments has a structure expandable in the vertical or horizontal direction, a large number of wafers may be polished at the same time. Thus, the wafer polishing apparatus according to the embodiments may improve process productivity and realize more economical double side polishing process.

As described above, in the wafer polishing apparatus according to the embodiments, the polishing roller may be rotated or moved to intermittently contact the wafer. Thus, the wafer polishing apparatus according to the embodiments may increase a quality maintenance time of the polishing pad and improve a life-cycle of the polishing pad. Also, in the wafer polishing apparatus according to the embodiments, the polishing pad may be varied in shape through a pressing medium. Thus, the wafer polishing apparatus according to the embodiments may realize diversified or differential polishing processes according to a quality state of the wafer.

In the descriptions of embodiments, it will be understood that when a wafer, a roller, a pad, a module, or a plate is referred to as being 'on' a wafer, a roller, a pad, a module, or a plate, it can be directly on another layer or substrate, or intervening layers may also be present. Further, it will be understood that when a layer is referred to as being 'under' another layer, it can be directly under another layer, and one or more intervening layers may also be present. Further, the reference about 'on' and 'under' each layer will be made on the basis of drawings. In the drawings, the size of each element is exaggerated for convenience in description and clarity. Also, the size of each element does not entirely reflect an actual size.

Hereinafter, the preferred embodiments will be described in detail with reference to the accompanying drawings. Prior to this, terms or words used in the specification and claims should not be construed as limited to a lexical meaning, and should be understood as appropriate notions by the inventor based on that he/she is able to define terms to describe his/her invention in the best way to be seen by others.

Therefore, embodiments and drawings described herein are simply exemplary and not exhaustive, and it will be understood that various modifications and equivalents may be made to take the place of the embodiments.

Figure 2:
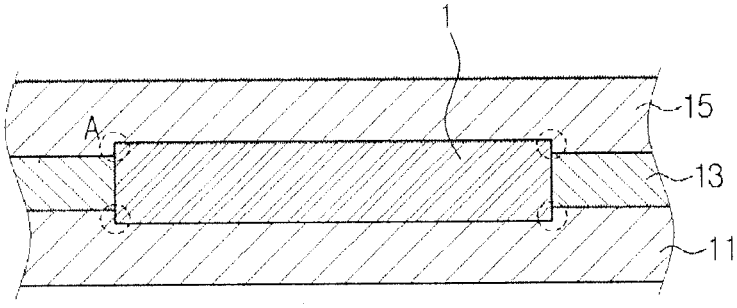
FIG. 2 is a sectional view of the double side polishing apparatus according to the first embodiment.
Figure 3:
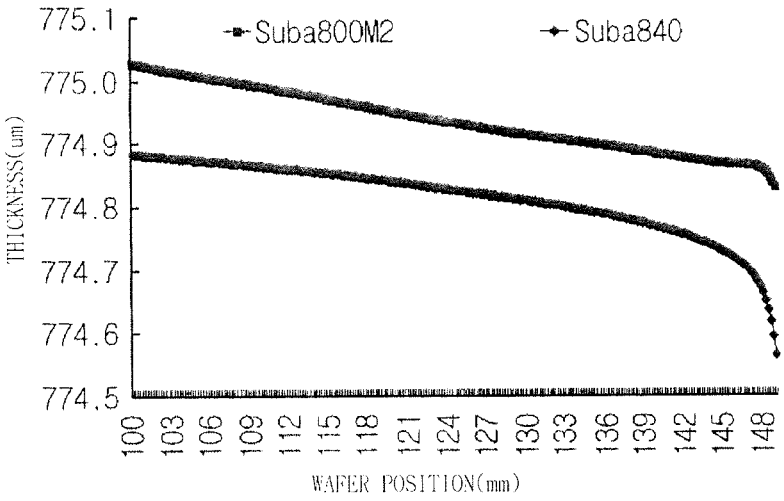
FIG. 3 is a graph illustrating a wafer profile by the double side polishing apparatus according to the first embodiment.

FIG. 1 is a perspective view of a double side polishing apparatus according to a first embodiment. FIG. 2 is a sectional view of the double side polishing apparatus according to the first embodiment. FIG. 3 is a graph illustrating a wafer profile by the double side polishing apparatus according to the first embodiment.

Referring to FIG. 1, a double side polishing apparatus 10 includes an upper plate 15 on which a polishing pad is attached to a bottom surface thereof, a lower plate 11 on which the polishing pad is attached to a top surface thereof, the lower plate 11 being disposed facing the upper plate 15, and a carrier 13 in which a wafer 1 that is a target to be polished is mounted into a mounting hole 16, the carrier 13 being disposed between the upper plate 15 and the lower plate 11.

When simply examining operations and structure relations, an internal gear 12 is disposed on an outer circumference of the lower plate 11. A sun gear 14 is disposed at a central portion of the apparatus 10. The carrier 13 on which at least one wafer 1 is mounted is engaged with the internal gear 12 and the sun gear 14, and thus is rotated.

In the above-described structure, the target wafer 1 to be polished on both surfaces thereof is mechanochemically polished by a friction force due to a rotation movement with the polishing pads attached to the upper plate 15 and the lower plate 11 and a reaction of slurry that is a polishing solution in which polishing particles and various additives are mixed.

The internal gear and the sun gear may be independently rotatable. Also, degrees (period and number) of rotation and revolution of the carrier 13 are determined according to a rotation ratio or rate of each of shafts. The wafer 1 loaded on the carrier 13 is rotated corresponding to the rotation or revolution of the carrier 13. Thus, the wafer 1 may be polished by the friction force with the pads contacting both top and bottom surfaces thereof.

Since the double side polishing apparatus 10 according to the first embodiment should include a plate having a size of greater than about 1,500 mm, it is difficult to secure a flatness of a predetermined level or more. Also, since chemical resistance is required, a specific material such as SUS should be selectively used. Thus, manufacturing costs may be expensive.

Also, since a rotation structure such as the plate having a weight of greater than about 1,000 kg should be realized, the double side polishing apparatus 10 is unnecessarily complicated and an expansive auxiliary control device is required. Also, it is nearly difficult to precisely control the flatness of the plate having a considerable size and weight during the performing of the process. In the wafer double side polishing apparatus 10 according to the current embodiment, the polishing pad having a size corresponding to that of the plate and the same physical property as that of the plate should be manufactured. Thus, very expensive manufacturing costs are required. Also, it is very difficult to mount the pad having a large size on the plate.

When examining mechanical polishing efficiency by the plate and pad, the wafer 1 fitted into the mounting hole 16 of the carrier 13 has a sectional structure as shown in FIG. 2. Since a pressure by the upper plate 15 and the lower plate 11 is concentrated into an edge portion expressed by a reference symbol A of FIG. 2, the edge portion of the wafer may be deteriorated in quality. Thus, this is a serious problem that cannot be ignored in consideration of the tendency of large-scaled wafers.

With the longer-term performance of such the process, the pressure may be accumulated to vary a thickness of the pad during the compression. Also, as shown in FIG. 3, since the wafer has an intense profile toward an edge, it is difficult to secure uniform quality of a predetermined level or more. Accordingly, a replacement cycle of a new plate or pad may be shorter or frequent. The above-described limitations may be more amplified.

Figure 4:
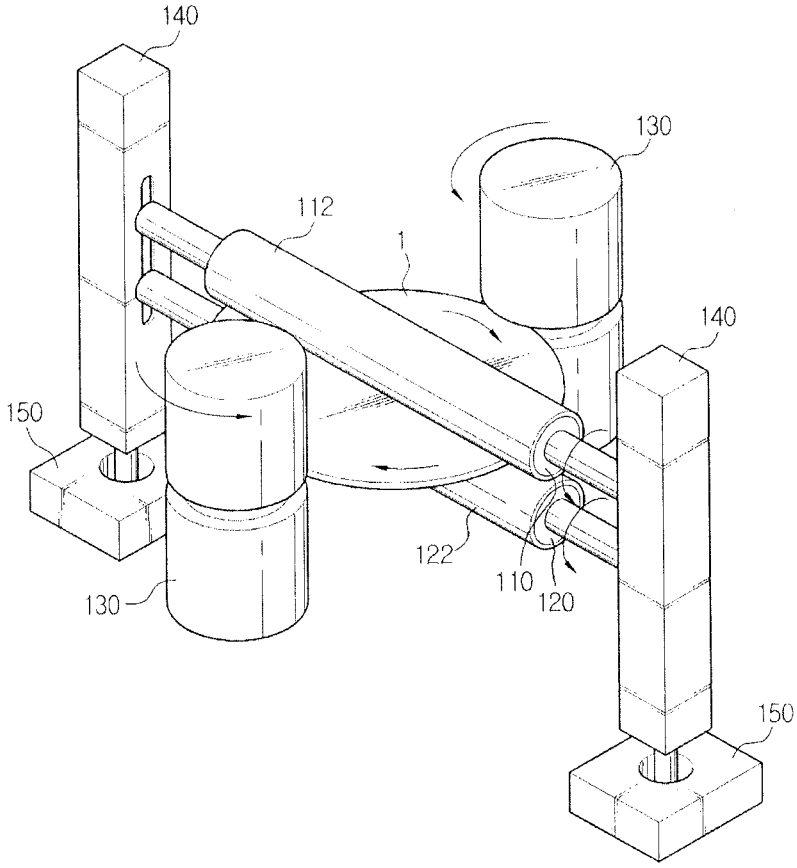
FIG. 4 is a perspective view illustrating a double side polishing apparatus of a roller structure according to a second embodiment.
Figure 5:
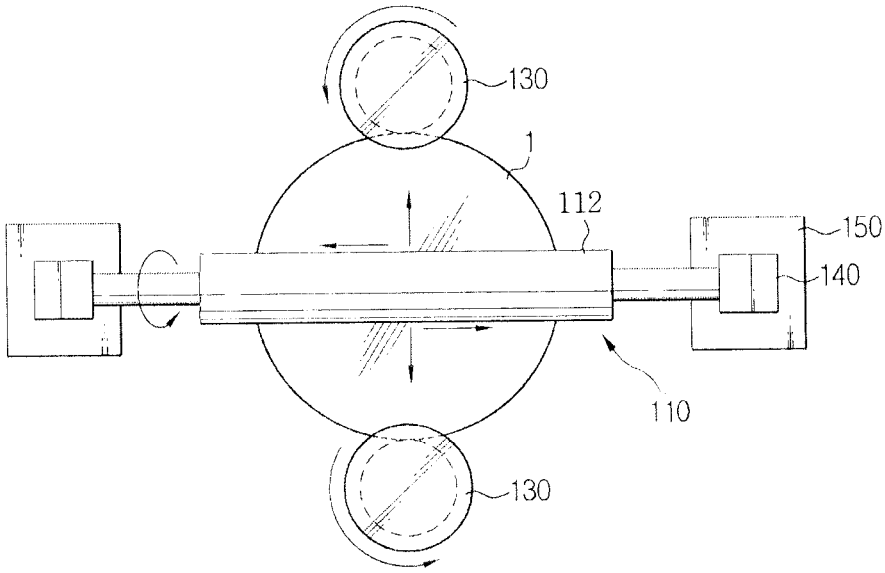
FIG. 5 is a view of a position adjustment module.
Figure 6:
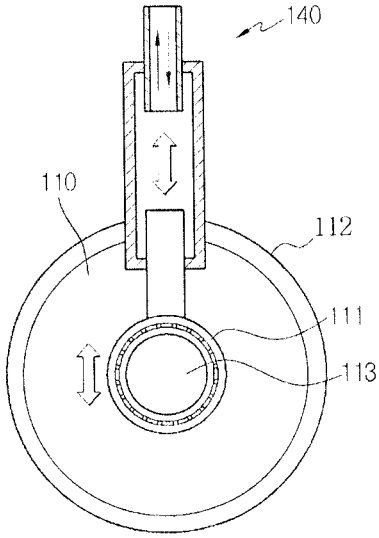
FIG. 6 is a view of a pressure adjustment module.
Figure 7:
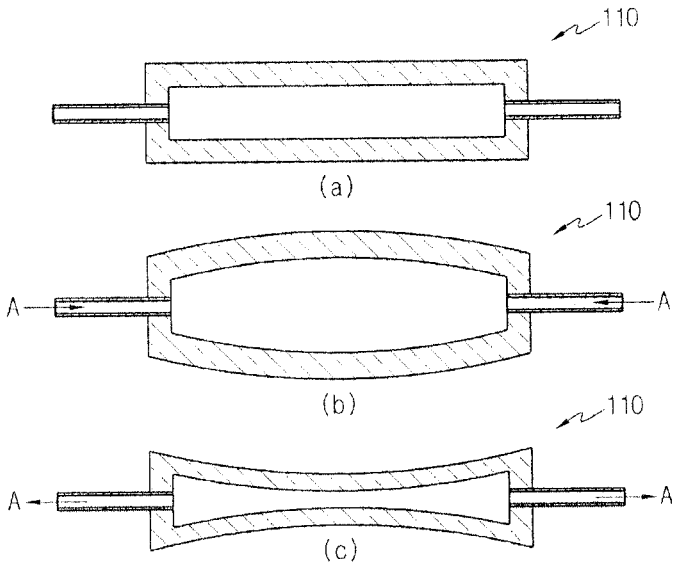
FIG. 7 is a view illustrating variable shapes of a polishing roller.
Figure 8:
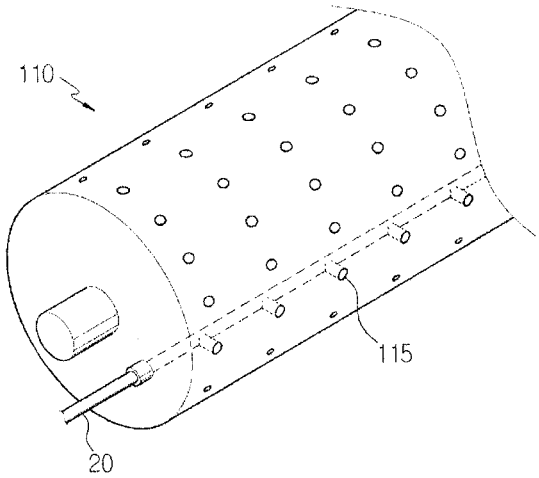
FIG. 8 is a view of a slurry discharge hole.
Figure 9:
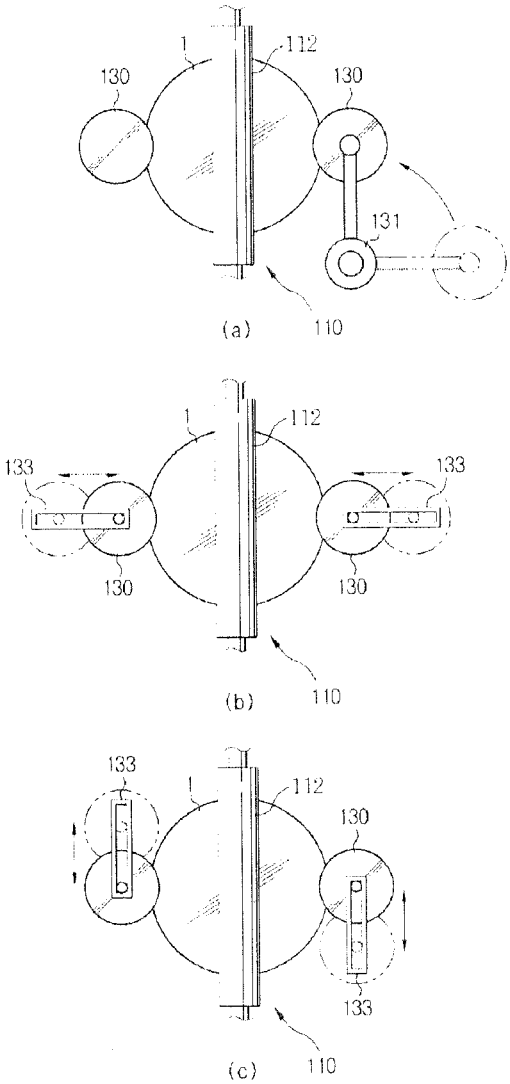
FIG. 9 is a view illustrating structures of a rotation driving module and a movement module and an operation relation between the rotation driving module and the movement module.
Figure 10:
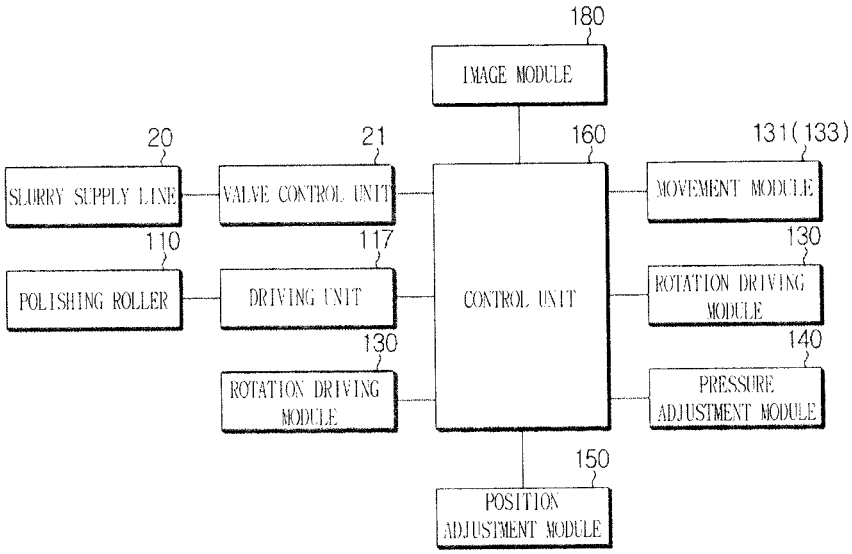
FIG. 10 is a block diagram illustrating a relationship among components with respect to a control unit.

FIG. 4 is a perspective view illustrating a double side polishing apparatus of a roller structure according to a second embodiment. FIG. 5 is a view of a position adjustment module. FIG. 6 is a view of a pressure adjustment module. FIG. 7 is a view illustrating variable shapes of a polishing roller. FIG. 8 is a view of a slurry discharge hole. FIG. 9 is a view illustrating structures of a rotation driving module and a movement module and an operation relation between the rotation driving module and the movement module. FIG. 10 is a block diagram illustrating a relationship among components with respect to a control unit.

Referring to FIGS. 4 to 10, a double side polishing apparatus of a roller structure according to a second embodiment includes a first polishing roller 110, a second polishing roller 120, a rotation driving module 130, a pressure adjustment module 140, and a position adjustment module 150.

The double side polishing apparatus according to the current embodiment has a structure in which a polishing unit having a roller shape is adopted to improve the structural limitation of the polishing apparatus according to the first embodiment. As shown in FIG. 4, the polishing unit includes a first polishing roller 110 contacting a top surface of a wafer 1, rotated around a center of a length direction as an axis, and having a cylindrical shape and a second polishing roller 120 facing the first polishing roller 110, contacting a bottom surface of the wafer 1, and rotated around a center of a length direction as an axis.

The first polishing roller 110 is disposed on the wafer 1. In detail, the first polishing roller 110 is disposed on the top surface of the wafer 1.

The first polishing roller 110 extends in a direction equal to that in which the wafer extends. In detail, the first polishing roller 110 may extend in a diameter direction of the wafer 1. In more detail, the first polishing roller 110 may extend in a direction substantially parallel to that of the wafer 1.

The first polishing roller 110 is rotated using the extending direction as a rotation axis. That is, the rotation axis of the first polishing roller 110 may extend in the diameter direction of the wafer 1. That is, the rotation axis of the first polishing roller 110 is substantially parallel to that of the wafer 1.

The second polishing roller 120 is disposed on the wafer 1. In detail, the second polishing roller 120 is disposed on the bottom surface of the wafer 1.

The second polishing roller 120 extends in a direction equal to that in which the wafer extends. In detail, the second polishing roller 120 may extend in a diameter direction of the wafer 1. In more detail, the second polishing roller 120 may extend in a direction substantially parallel to that of the wafer 1.

The second polishing roller 120 is rotated using the extending direction as a rotation axis. That is, the rotation axis of the second polishing roller 120 may extend in the diameter direction of the wafer 1. That is, the rotation axis of the second polishing roller 120 is substantially parallel to that of the wafer 1.

The first polishing roller 110 and the second polishing roller 120 have the extending directions corresponding to each other. That is, the extending direction of the first polishing roller 110 is substantially equal to that of the second polishing roller 120. That is, the first polishing roller 110 and the second polishing roller 120 may be parallel to each other.

Pads 112 and 122 for polishing are disposed on outer peripheral surface of the first and second polishing rollers 110 and 120, respectively. The pads 112 and 122 physically contact the wafer 1 to perform a polishing process. As shown in the drawings, since each of the polishing rollers 110 and 120 has a roller structure having a cylindrical shape, the roller structure may be transformed into a structure in which the polishing rollers 110 and 120 intermittently contact the wafer 1. As a result, the contact limitation, which may cause quality deterioration of the pad, with continuously loaded wafers may be overcome.

Also, to improve efficiency of the wafer polishing processing, the rotation driving module 130 according to the current embodiment may contact a side surface of the wafer 1 to transmit a rotation deriving force to the wafer 1.

That is, the wafer 1 receives the rotation force of the rotation driving module 130 and is rotated. In this state, the first and second polishing rollers 110 and 120 are rotated to perform the polishing process. To realize more preferred embodiment, as shown in FIG. 4, the rotation driving module 130 has a groove to physically support the target wafer 1 to be polished. Here, the wafer 1 may be fitted into the groove. That is, the groove is defined along an outer peripheral surface of the rotation driving module 130.

Also, since the rotation driving module 130 physically and directly contacts the side surface of the wafer 1, the rotation driving force may be effectively transmitted to the wafer 1. Also, to minimize a physical damage of the side surface of the wafer 1, the outer peripheral surface of the rotation driving module 130 may be formed of an elastic material such as rubber.

The rotation driving module 130 includes an elastomer contacting an edge of the wafer 1. Only a portion of the rotation driving module 130 contacting the wafer 1 may be formed of the elastomer.

Through such the structural improvement, the wafer double side polishing apparatus according to the current embodiment does not include a carrier for temporally receiving the wafer 1. Thus, the wafer double side polishing apparatus according to the current embodiment may fundamentally solve the limitations occurring by the carrier, e.g., limitations in which a wear rate of the physically restricted edge portion of the wafer 1 is increased and the processing is inefficient.

As described above, the position adjustment module 150 for adjusting positions of the first and second polishing rollers 110 and 120 may be additionally provided to allow the first and second polishing rollers 110 and 120 to be maintained at a center portion of the wafer 1.

A detailed structure of the position adjustment module 150 will be described with reference to FIG. 5. As shown in FIG. 5, the position adjustment module 150 may be configured to adjust the positions of the first and second polishing rollers 110 and 120 and be configured to control postures or positions of the polishing rollers 110 and 120 so that the first and second polishing rollers 110 and 120 are maintained at a center or central portion on a surface of the wafer 1 even though external effects such as external vibration or shake occur. Also, to improve operation efficiency, the first and second polishing rollers 110 and 120 may be movable from an upper end to a lower end of the wafer 1.

The position adjustment module 150 may adjust the positions of the first and second polishing rollers 110 and 120 through devices such as a step motor or gear and a guiding module. Thus, if the first and second polishing rollers 110 and 120 are physically movable in position, it will be understood by those of ordinary skill in the art that various changes in form. In FIG. 4, as one example, the position adjustment module 150 is disposed at a lower end of the apparatus to move a support structure of the pressure adjustment module 140 (that will be described alter) in itself. Thus, relative positions of the first and second polishing rollers 110 and 120 with respect to the wafer 1 may be movable.

To realize more preferred embodiment, images of the current states of the first and second polishing rollers 110 and 120 may be obtained using a predetermined image module. The obtained current state images and a reference image that is a standard for controlling a position may be matched with each other to perform a comparison operation. Then, a control signal corresponding to the obtained result may be generated to automatically operate the position adjustment module 150.

Hereinafter, the pressure adjustment module 140 will be described in detail with reference to FIG. 6. The pressure adjustment module 140 according to the current embodiment is a module for adjusting a pressure at which the first and second polishing rollers 110 and 129 compress the wafer 1. The pressure adjustment module 140 may adjust a pressure applied to the target wafer 1 to perform differential operations according to states of the wafer 1.

Also, the first and second polishing rollers 110 and 120 are supported by the pressure adjustment module 140. That is, the pressure adjustment module 140 supports both ends of the first and second polishing rollers 110 and 120.

FIG. 4 illustrates an embodiment in which the pressure adjustment module 140 physically supports the first and second polishing rollers 110 and 120 as an example.

The pressure adjustment module 140 may be realized as a hydraulic cylinder, which is operated by a pressure of a fluid introduced from or discharged into the outside. As shown in FIG. 6, when the fluid is introduced from or discharged into the outside, the cylinder structure vertically moves a predetermined bearing structure 111 surrounding a central shaft 113 of the first and second polishing rollers 110 and 120. Thus, the pressure at which the first and second polishing rollers 110 and 120 compress the wafer 1 may be adjusted.

The pressure adjustment module 140 may generate differential pressures according to an external control signal generated by a worker to apply the differential pressure according to operation conditions. Also, the pressure adjustment module 140 may be automatically controlled by an automatic system according to a processed degree of the wafer 1, a proceeding degree of the process, a kind of wafer, installation environment, a specification of a product.

FIG. 7 is a view illustrating variable shapes of a polishing roller for performing differential polishing processing. Referring to FIG. 7, the first or second roller 110 or 120 may have a structure in which a central portion of a side surface of the cylindrical shape is contractible or expandable to have a convex or concave shape.

As shown in FIG. 7, an empty space is defined in the first or second polishing roller 110 or 120. A thermal medium or pressing medium may be introduced into or discharged from the inner space to extract or expand the first or second polishing roller 110 or 120.

That is, the first and second polishing rollers 110 and 120 may be extracted or expanded according to a change of the internal pressure of the empty space. Thus, each of the first and second polishing rollers 110 and 120 may have a diameter gradually increased or decreased from the central portion toward the outside.

Due to the extraction or expansion, the first or second polishing roller 110 or 120 may be varied in outer appearance. That is, the first or second polishing roller 110 or 120 may have a shape gradually varied from a concave shape to a convex shape with respect to a portion contacting the wafer 1.

As described above, since the polishing roller is varied in physical shape, a selective and optimized polishing process may be performed according to the state of the pads, the specification of the wafer, and the state of the wafer, and the proceeding degree of the process. As a result, high-quality wafer may be manufactured.

As described above, the double side polishing process may be complexly performed through the mechanical polishing performed by the pad and the chemical polishing performed by the slurry. In the current embodiment, the slurry may be supplied between the first or second polishing roller 110 or 120 and the wafer through a slurry supply part such as an external slurry supply line or nozzle.

Referring to FIG. 8, at least one discharge hole 115 through which the slurry is supplied is defined in an outer peripheral surface of the first or second polishing roller 110 or 120. The slurry introduced from the external slurry supply line 20 may be supplied to the target wafer through the discharge hole 115.

As described above, since an additional part for supplying the slurry is not provided, the apparatus may be more compact. Also, since the slurry is supplied through the surface of the polishing rollers 110 and 120 contacting the wafer, the chemical effect by the slurry may be further improved. In addition, it may prevent the slurry from be unnecessarily supplied, thereby minimizing waste of the slurry.

To further improve a synergy effect of the mechanical polishing and the chemical polishing, a control unit (see reference numeral 160 of FIG. 10) may be provided. Here, the control unit controls the slurry to selectively supply the slurry into the discharge hole 115 only when the first or second roller 110 or 120 contacts or approaches the wafer 1.

The control unit 160 controls an on/off operation of a valve of the discharge hole 115 or the slurry supply line 20 through a solenoid valve or mechanic or electronic relay unit so that the slurry is introduced through the discharge hole 115 at a predetermined time when the polishing rollers 110 and 120 contact the wafer 1 or before the polishing rollers 110 and 120 contact the wafer 1 according to parameters such as a distance between the polishing roller 110 or 115 and the wafer 1, orientation of the polishing roller 110 or 115, a rotation direction of the polishing roller 110 or 115, and rotation speed of the polishing roller 110 or 115.

FIG. 9 is a view illustrating structures of a rotation driving module 130 and a movement module 131 for operating the rotation driving module according to an embodiment.

The rotation driving module 130 may contact a side surface of a target wafer 1 to be polished to rotate the wafer 1 as described above.

As shown in FIG. 9, the movement module 133 may move the rotation driving module to allow the rotation driving module to contact the wafer 1 or be spaced from the wafer 1, thereby adjusting an intensity of a contact friction force of the rotation driving module 130 for rotating the wafer 1 and effectively performing loading or unloading of the wafer 1.

As described as an example in FIG. 9, the movement module 131 may have an arm shape. Also, the movement module 131 may rotate the rotation driving module 130 within a rotation radius. Alternatively, as shown in FIGS. 9A and 9B, the movement module 131 may vertically or horizontally move the rotation driving module 130 with respect to a tangential line of a side surface.

Referring to FIG. 10, a logical relationship among components with respect to the control unit will be simply described.

As shown in FIG. 10, the control unit 160 according to an embodiment is connected to a driving unit 117 for introducing or discharging a thermal or pressing medium into or from the polishing module 110 to control the driving unit 117. Also, as described above, the control unit 160 is connected to a valve control unit 21 for controlling a valve of the slurry supply line 20 connected to the discharge hole 115 of the polishing roller 110 to control an on/off operation of the valve control unit 21.

Also, as described above, the control unit 160 is connected to the image module 180 to control each of the components through various operations using image data inputted from the image module 180 and previously stored reference image data as parameters.

The control unit 160 is communicably connected to the rotation driving module 130 to control a rotation speed and a rotation direction of the rotation driving module 130. Also, the control unit 160 is connected to movement modules 133 and 131 for moving the rotation driving module 130 to control a wafer contact intensity and position of the rotation driving module 130 and a rotation speed and rotation direction of the roller 110.

As one simple example, when the polishing process is completed, the control unit 160 controls the polishing rollers 110 and 120 to allow the polishing rollers 110 and 120 to be rotated in directions opposite to each other. Thus, a wafer on which the polishing process is completed may be easily unloaded. In addition, the control unit 160 controls the movement modules 131 and 133 to space the rotation driving module 130 from the wafer 1. When the wafer 1 is unloaded, a predetermined auxiliary unloading module (not shown) grasps the wafer 1 using an air pressure to unload the wafer 1 under the control of the control unit 160.

Also, the control unit 160 may be communicably connected to the position adjustment module 150 and the pressure adjustment module to control a position of the polishing roller and an intensity of a pressure applied to the wafer 1.

It should be understood that the components illustrated in FIG. 10 are components, which are not physically classified, but logically classified. That is, to realize technical idea of the present disclosure, since the components correspond to logically classified components, it should be construed as being included in the present disclosure if functions of the logical components of the present disclosure can be realized even though the components are integrated with or separated from each other.

Figure 11:
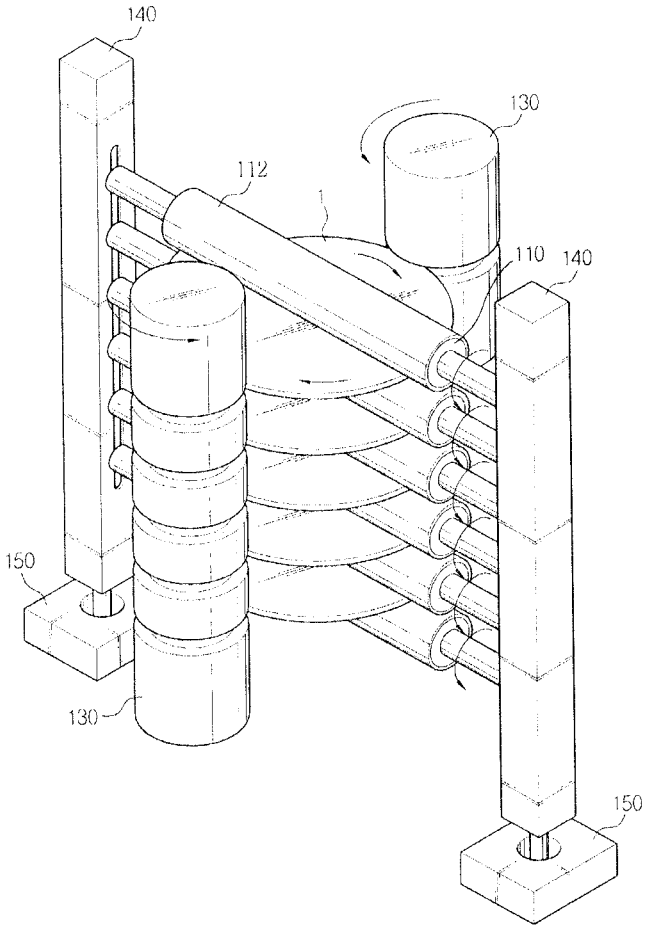
FIG. 11 is a view of a stack-type wafer polishing apparatus according to a third embodiment.
Figure 12:
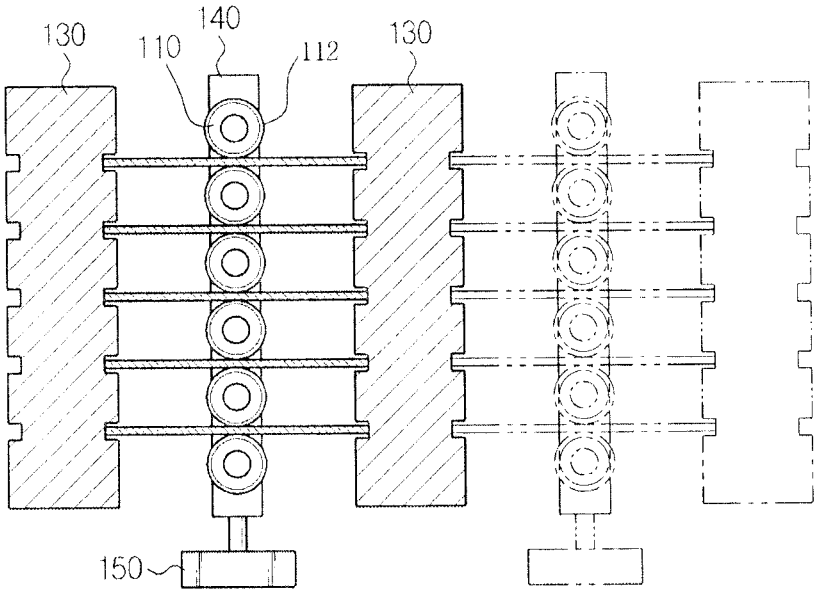
FIG. 12 is a view of a horizontal-type wafer polishing apparatus according a fourth embodiment.

FIG. 11 is a view of a stack-type wafer polishing apparatus according to a third embodiment. FIG. 12 is a view of a horizontal-type wafer polishing apparatus according a fourth embodiment. The current embodiment will be described with reference to the first and second embodiments. That is, the descriptions of the first and second embodiments may be fundamentally coupled to the current embodiment except modified parts.

Hereinafter, expansion of the polishing apparatus according to the current embodiment will be described with reference to FIGS. 11 and 12. The double side polishing apparatus according to the current embodiment may perform the polishing process using the roller structure, which is vertically moved with respect to the surface of the wafer to easily realize the expansion of the apparatus as shown in FIG. 11.

As shown in FIG. 11, a plurality of wafers 1 faces each other and is spaced from each other. Polishing rollers 110 are disposed between the wafers 1, respectively. Also, the polishing roller is disposed on the uppermost wafer 1 of the plurality of wafers 1. Also, the polishing roller is disposed on the lowermost wafer 1 of the plurality of wafers 1.

A rotation driving module 130 rotates the wafers 1. In detail, the rotation driving module 130 may entirely rotate the wafers 1. On the other hand, the rotation driving module 130 may separately rotate the wafers 1.

That is, the target wafers may be disposed between the polishing rollers 110. As described above, the rotation driving module 130 may have a structure in which the plurality of wafers 1 to be polished can be entirely rotated, i.e., a stack-type structure. When the rotation driving module 130 is realized as the stack-type structure, the number of the rotation driving module 130 may be increased corresponding to the number of the wafers to improve the process efficiency.

In addition, since the polishing apparatus adopts the roller structure having a cylindrical shape, as shown in FIG. 11, one polishing roller may contact a bottom surface of an upper wafer and a top surface of a lower wafer at the same time. Thus, due to the stack-type structure, the polishing apparatus may be easily expanded.

As shown in FIG. 12, the rotation driving module 130 may have a structure in which it rotates left wafers and right wafers at the same time. That is, the stacked right wafers are disposed on sides of the stacked left wafers, and the rotation driving module 130 may be disposed between the right wafers and the left wafers.

The rotation driving module 130 disposed between the right wafers and the left wafers may apply a rotation force to the left wafers and the right wafers.

That is, as shown in FIG. 12, the wafer double side polishing apparatus according to the current embodiment may be easily expanded in the horizontal direction. Also, as necessary, the wafer double side polishing apparatus may be easily expanded in the vertical and horizontal directions to improve the process performance efficiency.

As described above, the wafer double side polishing apparatus according to the current embodiment may efficiently polish the plurality of wafers.

Features, structures, and effects described in the above embodiments are incorporated into at least one embodiment of the present invention, but are not limited to only one embodiment. Moreover, features, structures, and effects exemplified in one embodiment can easily be combined and modified for another embodiment by those skilled in the art. Therefore, these combinations and modifications should be construed as falling within the scope of the present invention.

Although embodiments have been described with reference to illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

The wafer polishing apparatus according to the embodiments may be applicable to semiconductor industry fields.

What is claimed:

1. A wafer polishing apparatus comprising:

a polishing part disposed on at least one of a top and a bottom surface of a wafer; and a rotation driving module contacting an edge portion of the wafer to transmit a rotation force to the wafer, wherein the polishing part comprising:

a first polishing roller disposed on the top surface of the wafer, and a second polishing roller disposed on the bottom surface of the wafer, wherein the first polishing roller and the second polishing roller extend in a direction that the wafer extends, and wherein the first polishing roller includes a plurality of discharge holes disposed on an outer peripheral surface of the first polishing roller.

2. The wafer polishing apparatus of claim 1, wherein the first polishing roller is rotated around a rotation axis of the first polishing roller.

3. The wafer polishing apparatus of claim 1, further comprising a polishing pad disposed on an outer peripheral surface of the first polishing roller, wherein the polishing pad contacts the top surface of the wafer.

4. The wafer polishing apparatus of claim 1, further comprising a position adjustment module that adjusts a relative position of the first polishing roller with respect to the wafer.

5. The wafer polishing apparatus of claim 1, further comprising a pressure adjustment module that pushes the first polishing roller toward the wafer.

6. The wafer polishing apparatus of claim 1, wherein the first polishing roller has an empty space therein, and the first polishing roller is expanded or contracted by a variation in a pressure within the empty space.

7. The wafer polishing apparatus of claim 1, wherein the rotation driving module has a groove extending along an outer peripheral surface thereof, and wherein the wafer is inserted into the groove.

8. The wafer polishing apparatus of claim 1, wherein the rotation driving module comprises an elastomer contacting the wafer.

9. The wafer polishing apparatus of claim 1, wherein the first polishing roller and the second polishing roller extend in a diameter direction of the wafer.

10. The wafer polishing apparatus of claim 1, wherein the first polishing roller has a diameter gradually increasing from a central portion toward an end.

11. The wafer polishing apparatus of claim 1, wherein the first polishing roller has a diameter gradually decreasing from a central portion toward an end.

12. The wafer polishing apparatus of claim 1, further comprising a roller configuration changing part that deforms a configuration of the first polishing roller.

13. The wafer polishing apparatus of claim 1, further comprising a moving module that moves the rotation driving module.

* * * * *